United States Patent [19]

Debrey

[11] 4,358,095

[45] Nov. 9, 1982

[54] FURNACE

[76] Inventor: Andrew D. Debrey, 2531 37th Avenue, Rock Island, Ill. 61201

[21] Appl. No.: 213,284

[22] Filed: Dec. 5, 1980

[51] Int. Cl.[3] ..... F27B 14/00; F27B 3/00

[52] U.S. Cl. ..... 266/242; 266/214; 266/261; 75/65 R; 75/68 R

[58] Field of Search ..... 266/214, 242, 171, 199, 266/261; 75/65 R, 68 R; 65/335, 347

[56] References Cited

U.S. PATENT DOCUMENTS

| | | | |
|---|---|---|---|
| 2,020,101 | 11/1935 | Brown | 266/242 X |
| 2,264,740 | 12/1941 | Brown | 266/242 X |
| 2,331,887 | 10/1943 | Bonsack | 266/242 X |
| 2,624,565 | 1/1953 | Kompart | 266/242 X |
| 3,194,650 | 7/1965 | Kurzinski | 266/214 X |
| 3,567,203 | 3/1971 | Hess | 266/214 X |
| 3,735,968 | 5/1973 | Pearch | 266/242 |
| 3,917,242 | 11/1975 | Bass et al. | 75/68 R X |
| 4,060,408 | 11/1977 | Kuhn | 75/65 R X |

*Primary Examiner*—L. Dewayne Rutledge
*Assistant Examiner*—David A. Hey
*Attorney, Agent, or Firm*—Henderson & Sturm

[57] ABSTRACT

The invention relates to reverberatory furnaces used to operate upon baths of light metals, non-ferrous metals and alloys thereof. Reduction of wear on furnace walls, of energy used during operation and of dross formation on the metal bath, is achieved by a furnace (11) with a container (12) and roof (13) which form a shallow heating chamber (37) above the bath surface. A burner (14) directs a tight flame (39) to impinge against the bath surface.

4 Claims, 2 Drawing Figures

FURNACE

TECHNICAL FIELD

This invention relates to reverberatory furnaces. More particularly it concerns such furnaces employed for operating on aluminum and other light metals, non-ferrous metals and alloys thereof.

BACKGROUND ART

Furnaces employed for melting and holding non-ferrous metals, such as aluminum and alloys thereof, typically have employed heating chambers with a relatively large vertical dimension above the surface of the metal bath. Heating elements, usually gas burners, have been positioned in the side walls of the furnaces well above the surface of the metal bath being heated. U.S. Pat. Nos. 2,020,101 and 2,264,740 to Brown are examples of the typical arrangement.

A continuing problem in the art is to more efficiently transfer heat from the heating element to the metal bath, thereby to reduce energy requirements for operation of a furnace. As indicated in U.S. Pat. No. 2,331,887 to Bonsack, in melting and holding furnaces for light metals, non-ferrous metals and alloys thereof, it has been recognized to be undesirable to permit the products of combustion and the flame from the burners to come into direct contact with the surface of the metal bath. In attempts to provide a required heat and efficiency, conduit structures, disposed adjacent the metal bath, have been proposed which isolate the flame and combustion products from the bath.

Another continuing problem in the art, as pointed out in U.S. Pat. No. 3,735,968 to Pearch, is reduction of wear on the metal bath container due to unevent heating of the container resulting in hot spots. Heater bank structures, disposed adjacent the exterior of the container side walls and the combustion gases from which are sealed off from the metal bath, have been proposed.

DISCLOSURE OF INVENTION

The furnace of this invention includes a container for bearing a metal bath. A roof fits over the container and very close to the metal bath surface such that the heating chamber formed has a very small vertical dimension. A heating unit is fixed in the roof and directs a gas flame straight down and against the metal bath surface.

An object of this invention is to provide a furnace which transfers heat to a metal bath with increased efficiency.

Another object is provision of a furnace which in operation consumes lower amounts of fuel and produces a lesser amount of waste gases thereby.

A further object of this furnace invention is reduction of wear from operation and reduction of maintenance costs thereby.

Also an object of this invention is provision of a furnace which reduces dross formation in holding operations.

These objects and other features and advantages of this furnace invention will become readily apparent upon referring to the following description together with the appended drawings.

BRIEF DESCRIPTION OF THE DRAWINGS

The furnace invention is illustrated in the drawings wherein.

BEST MODE FOR CARRYING OUT THE INVENTION

Figure 1:
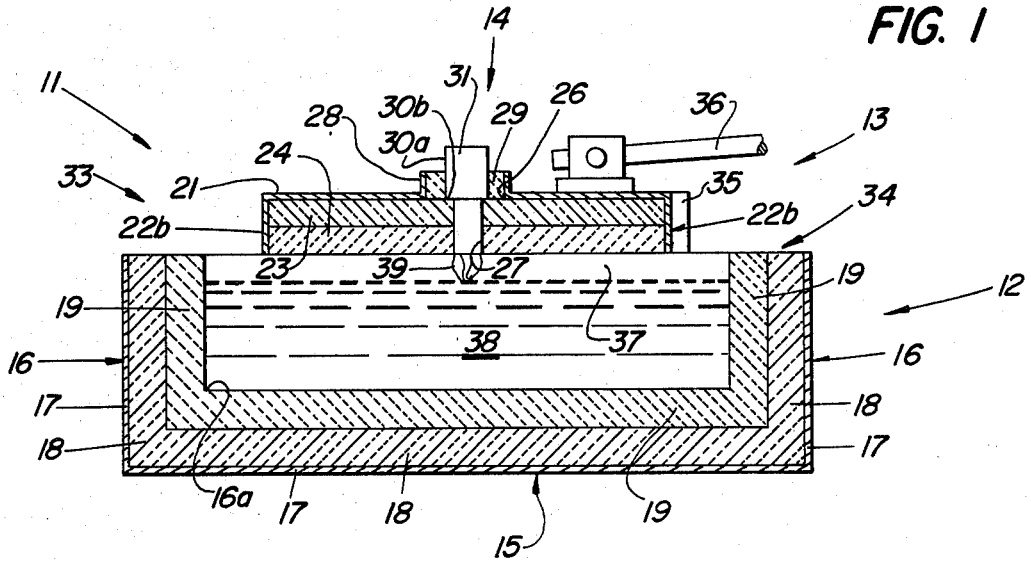
FIG. 1 is a fragmentary, vertical, longitudinal cross section taken along line 1—1 in FIG. 2, of the furnace in the closed position.

The furnace invention is indicated generally at 11 in FIG. 1. More particularly, the furnace 11 includes a container assembly 12, a roof assembly 13 and a burner assembly 14.

The container assembly 12 includes a rectangular bottom wall 15. Four generally rectangular side walls 16 extend upwardly from the periphery of the bottom wall 15, thereby forming a cavity 16*a*. The walls 16 each include bound together an external steel jacket 17, an intermediate insulation layer 18, and an internal refractory liner 19.

The roof assembly 13 includes a top, flat steel plate 21. End and side steel plates 22*a*, 22*b* extend downwardly from the periphery of the top plate 21. An interior insulation layer 23 is fixed to the underside of top plate 21 and extends transversely from side plate to side plate 22*a* and longitudinally from end plate to end plate 22*b*. An inner refractory liner 24 is fixed to the underside of the insulation layer 23. The liner 24 similarly extends to all plates 22*a*, 22*b*.

The burner assembly 14 includes an aperture 26 formed centrally through plate 21. Co-axial with, but having a smaller cross-sectional diameter than, aperture 26 is a bore 27 formed through insulation layer 23 and refractory liner 24. The bore 27 is generally cylindrical in conformation and is normal to top plate 21, layer 23 and liner 24.

Affixed to plate 21, about aperture 26, and extending upwardly therefrom, is an annular steel plate wall 28. A built-up annular insulation layer 29 is connected to wall 28 and layer 23 and forms a bore 30*a* co-axial with bore 27 and a shoulder area 30*b* on the upper surface of layer 23 adjacent bore 27.

Figure 2:
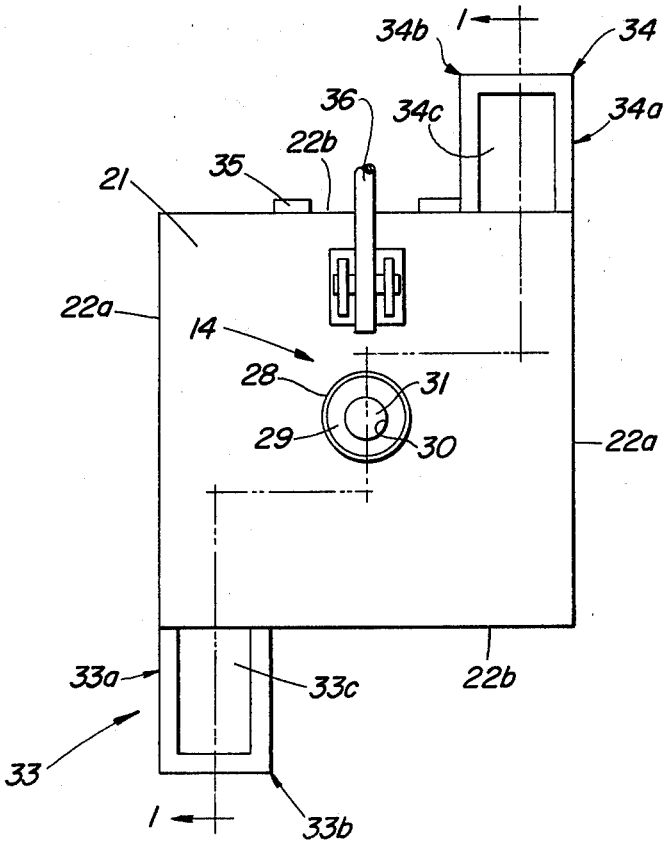
FIG. 2 is a fragmentary, top plan view of the furnace.

A high temperature, high pressure, tunnel gas burner 31, of 75,000 BTU, is provided. The body of the burner 31 rests upon shoulder 30*b* and snugly within bore 30*a*. The nozzle of the burner 31 projects downwardly and fits snugly within bore 27. The body of burner 31 is shown schematically in FIGS. 1 and 2, and the fuel supply structures, being known in the art, have not been shown for reasons of clarity.

The container 12 includes charging and dip-out wells 33, 34 formed by modifications of walls 15, 16. Charging well 33 includes one wall 33*a* which is an elongation of a side wall 16, an L-shaped wall 33*b* which projects from an end wall 16, and a projection 33*c* from bottom wall 15. Similarly, dip-out well 34 includes a wall 34*a* which is an elongation of the opposite side wall 16, an L-shaped wall 34*b* which projects from the opposite end wall 16, and a projection 34*c* from bottom wall 15 in a direction opposite that of projection 33*c*.

The roof 13 is affixed to container 12, either in fixed relationship (in which case container 12 and roof 13 are oriented as shown in the drawings), or in hinged relationship (in which case the drawings show the down, or operating configuration, as opposed to the up, or maintenance configuration, of the furnace 11). In the latter case, the roof 13 is hinged, as at 35, to the end wall 16 bearing the dip-out well 34, and hydraulic lift mechanism 36 is attached to the top plate 21.

The furnace 11 is charged at well 33, and molten metal is dipped-out at well 34, by methods known in the art. The furnace 11 is in the down, or operating, position illustrated in the drawings when in use. A heating chamber 37, preferably 2.5 to 5 cm (1 to 2 inches) in vertical dimension, is formed between the surface of the metal bath 38 in cavity 16*a* and the refractory liner 24 of the roof 13. A tight flame 39 is directed straight down and impinges upon the bath 38 surface with high temperature and high pressure.

INDUSTRIAL APPLICABILITY

Direct impingement of a hard, tight flame 39 in a small chamber 37 results in very efficient transfer of heat from the burner assembly 14 to the metal bath 38. This results in substantial reduction in fuel costs and facilitates use of a smaller burner in the furnace 11 (250,000 BTU burners being employed typically in the art), thereby further resulting in lessening of fuel costs. Also, less waste gas is produced because less fuel is burned.

Wear is substantially reduced because high temperature blasts are not directed toward the liners 19 of the walls 16. Formation of aluminum oxide deposits on the liners 19 of the walls 16 is greatly reduced, as the chamber 37 is small and there is little exposure of the liners 19. Cleaning and maintenance costs thereby are reduced.

Also, dross formation in holding operations has been reduced.

The furnace 11 of this invention has substantial industrial applicability. Although a preferred embodiment has been disclosed herein, various modifications and alternate constructions can be made without departing from the full scope of the invention defined in the claims.

I claim:

1. A furnace for operation upon baths of light metals, non-ferrous metals and alloys thereof, said furnace comprising:

container means for holding the metal bath; roof means attached to said container means, and cooperating with said container means to form a shallow heating chamber between the surface of the bath and the underside of said roof means;

shallow heating chamber means formed between the surface of the bath and underside of said roof means by cooperation of said container and roof means; and fuel-burner means, carried by the opening through roof means, for directing a flame downwardly to impinge against the metal bath surface, and said heating chamber shallow dimension is from 2.5 to 5.0 centimeters, between the surface of the bath and said roof means underside.

2. The furnace of claim 1 and further wherein said fuel-burner means is rated at 75,000 BTU.

3. A furnace for operation upon baths of light metals, non-ferrous metals and alloys thereof, said furnace comprising:

container means for holding the metal bath;

roof means attached to said container means;

shallow heating chamber means formed between the surface of the bath and underside of said roof means, by cooperation of said container and said roof means; and fuel-burner means, carried by and opening through said roof means, for directing a flame downwardly to impinge against the metal bath surface.

4. A method of holding a bath of light metal or light metal alloy, comprising the steps of placing a bath of a quantity of such metal or metal alloy in a container at least partially covered by a roof means, forming a heating chamber such that the bath surface is disposed 2.5 to 5.0 cms from the roof means' undersurface, and directing a high temperature, high velocity flame to impinge normal to the surface of the bath.

* * * * *

UNITED STATES PATENT AND TRADEMARK OFFICE

CERTIFICATE OF CORRECTION

PATENT NO. : 4,358,095

DATED : November 9, 1982

INVENTOR(S) : Andrew D. Debrey

It is certified that error appears in the above-identified patent and that said Letters Patent are hereby corrected as shown below:

In column 4, lines 9-12, within claim 1, delete the language, "shallow heating chamber means formed between the surface of the bath and underside of said roof means by cooperation of said container and roof means; and". In column 4, line 13, within claim 1, delete "the" and substitute --and-- therefor.

Signed and Sealed this

*First* Day of *February 1983*

[SEAL]

*Attest:*

GERALD J. MOSSINGHOFF

*Attesting Officer*

*Commissioner of Patents and Trademarks*